United States Patent [19]

Belkin et al.

[11] 4,420,346

[45] Dec. 13, 1983

[54] METHOD OF PREPARING CONTACTS AND ELECTRODES OF ELECTRIC VACUUM APPARATUSES

[76] Inventors: German S. Belkin, ulitsa 1 Maya, 1, kv. 46, Zheleznodorzhry, Moskovskaya oblast; Stal N. Voskresensky, Angarskaya ulitsa, 49, korpus 1, kv. 22, Moscow; Viktor Y. Kiselev, Perovskaya ulitsa 40, korpus 4, kv, 12, Moscow; Ida A. Lukatskaya, ulitsa Moldagulovoi, 28 korpus 3, kv. 68, Moscow; Valery V. Rodionov, ulitsa Metallurgov, 41-b, kv. 22, Tula; Mikhail N. Skurikhin, Martenovskava ulitsa, 21/12, kv. 1, Tula; Irina B. Frolova, ulitsa Metallurgov. 43-a, kv. 69, Tula; Vyacheslav S. Zuev, ulitsa Bratiev Zhabrovykh, 32, kv. 160, Tula; Lev I. Kornevv, ulitsa Anosova, 8/16, kv. 1, Tula; Rauza A. Chervonenkis, ulitsa Butlerova, 26, korpus 2, kv. 33, Moscow; Efim M. Rabinovich, ulitsa Metallurgov, 35/7, kv. 35, Tula; Tatyana P. Volkova, ulitsa Chaplygina, 619 kv, 21, Tula; German A. Goryaev, Priupskaya ulitsa, 9-a, kv. 85, Tula, all of U.S.S.R.

[21] Appl. No.: 403,648

[22] PCT Filed: Nov. 28, 1980

[86] PCT No.: PCT/SU80/00187

§ 371 Date: Jul. 16, 1982

§ 102(e) Date: Jul. 16, 1982

[87] PCT Pub. No.: WO82/01960

PCT Pub. Date: Jun. 10, 1982

[51] Int. Cl.[3] ..... C25D 5/34

[52] U.S. Cl. ..... 148/4; 148/13; 148/152

[58] Field of Search ..... 148/4, 13, 152; 219/121 LE, 121 LF, 121 EF, 121 EG, 121 PA, 121 PB

[56] References Cited

U.S. PATENT DOCUMENTS

| | | | |
|---|---|---|---|
| 2,968,723 | 1/1961 | Steigerwald | 148/152 |
| 4,122,240 | 10/1978 | Banas et al. | 219/121 LE |
| 4,179,316 | 12/1979 | Connors et al. | 148/152 |

*Primary Examiner*—L. DeWayne Rutledge
*Assistant Examiner*—S. Kastler
*Attorney, Agent, or Firm*—Myron Greenspan; Burton L. Lilling; Bruce E. Lilling

[57] ABSTRACT

A method of preparing contacts and electrodes of electric vacuum apparatuses comprising the steps of exposing the contact (electrode) surface to a concentrated thermal flux of $10^4$ to $10^6$ W/cm$^2$ 1 in a vacuum or in the environment of an inert gas for 21 to 100 ms and subjecting said surface to subsequent cooling at a cooling rate ranging from $10^4$ to $10^6$ K/s.

1 Claim, 2 Drawing Figures

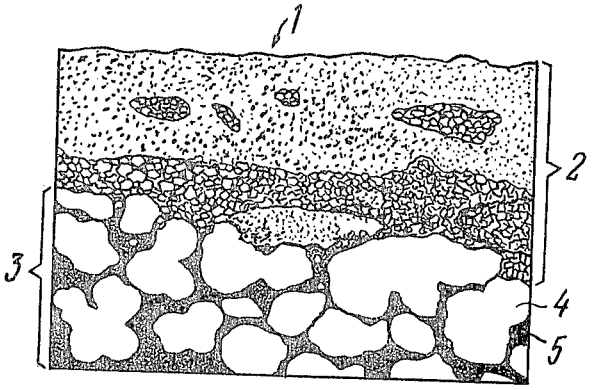
FIG.1
FIG.2
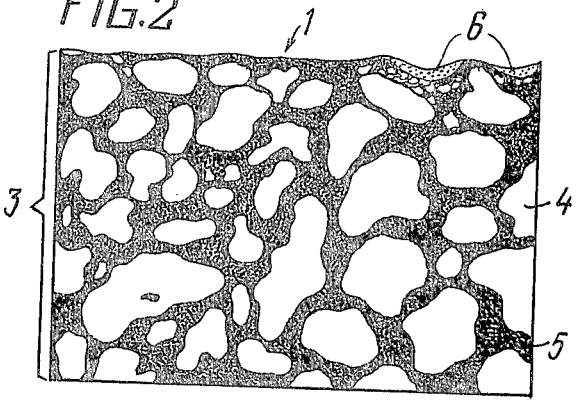

METHOD OF PREPARING CONTACTS AND ELECTRODES OF ELECTRIC VACUUM APPARATUSES

TECHNICAL FIELD

The invention relates to high-tension switchgear and more particularly to methods of preparing contacts and electrodes of electric vacuum apparatuses.

BACKGROUND ART

Electric vacuum apparatuses which relate to vacuum arc extinction chambers and vacuum gaps can operate reliably only when their contacts or electrodes are subject to special preparation treatment. Adequate methods of contact and electrode preparation provide for higher operational reliability and greater electric strength of electric vacuum apparatuses.

Known in the art are contact and electrode preparation methods which consist in the degassing of contacts and electrodes by initiating a d.c. discharge between them in the environment of an inert gas or hydrogen (cf. the USSR Inventor's Certificate No.588,573, Int.cl. HO1H 33/66, published in bulletin "Discoveries, Inventions, Industrial Designs and Trademarks", No. 2, 1978; Japanese Application No. 50-39,827, Int.cl. HO1H 33/66).

Such degassing methods make it possible to remove surface impurities and gas contaminants without changing the structure of the contact or electrode, a feature not providing for an improvement of the electric strength and operational reliability of an electric vacuum apparatus.

There are methods of contact preparation in which contacts are subject to heat treatment in an electric furnace, in the environment of hydrogen or in a vacuum (cf. Japanese Application No. 51-3073, Int.cl. HO1H 33/66) and also methods utilizing electron beam for the purpose (cf. Japanese Application No. 51-36.468, Int.cl. HO1H 33/66).

With the above methods, a contact is so prepared that its surface layer contains higher amount of a fusible component (copper) than the remaining contact areas. These methods, while providing for higher electric strength of an electric vacuum apparatus, result in a considerable increase in contact resistance, which imposes certain limitations on the rating of the current passing through a vacuum arc extinction chamber. Moreover, these methods can be implemented only in the case when there exists a large difference between the boiling points of the different contact metals as in the case of tungsten-copper material.

There is a contact preparation method dealing with an improvement of the electric strength of a vacuum arc extinction chamber by initiating an arc and cutting out the current that exceeds its rated value (cf. Japanese Application No. 51-8176, Int.cl. HO1H 33/66).

This method is capable of eliminating merely surface contact defects, which cannot provide for a high electric strength and, as a consequence, for a high working voltage of the chamber.

Known in the art is a method of preparing contacts and electrodes of electric vacuum apparatuses by using a heavy-current short-duration arc (cf. the USSR Inventor's Certificate No. 756,510, Int.cl. HO1H 33/68, published in bulletin "Discoveries, Inventions, Industrial Designs and Trademarks", No. 30, 1980). According to the method, an arc is stricken between the electrodes or separated contacts of an electric vacuum apparatus by applying a current pulse of a length of 5 to 20 ms at 10 to 100 kA, with the space between the electrodes or contacts being maintained within the range 5 to 100 mm. Under these circumstances, a concentrated thermal flux acts on the surface of the electrodes or contacts for 0.5 to 20 ms and that surface is then subject to cooling.

As a result, the surface is degassed and chemically sorbed gases are removed from it at a minimum contact (electrode) erosion. This means that the surface layer of the contacts (electrodes) neither melts nor changes its structure. Thus, the method fails to improve efficiently the electric strength and operational reliability of electric vacuum apparatuses.

DISCLOSURE OF THE INVENTION

The invention seeks to attain a method of preparing contacts and electrodes of electric vacuum apparatuses in which their surfaces are exposed to a concentrated thermal flux and is then cooled in such a manner that a layer is formed on that surface which has a structure resembling "pseudoeutectic", thereby improving electric strength and operational reliability of electric vacuum apparatuses.

This aim is attained in a method of preparing contacts and electrodes of electric vacuum apparatuses, comprising the steps of exposing the surface of the contacts (electrodes) to a concentrated thermal flux of $10^4$ to $10^6$ W/cm$^2$ in a vacuum or in the environment of an inert gas and subjecting that surface to subsequent cooling, according to the invention, said concentrated thermal flux is applied for 21 to 100 ms and the rate of cooling during the cooling step is chosen to be within the range $10^4$ to $10^6$ K/s.

During the application of a concentrated thermal flux to the contact (electrode) surface, there results a formation of a layer of molten metal 0.1 to 3 mm thick, said layer being crystallized during the cooling step and a fused metal layer being provided.

The minimum and maximum thickness of the fused metal layer, i.e. 0.1 and 3 mm, correspond to the respective lower and upper values of the specified ranges for the concentrated thermal flux and time of its application. It is not expedient to use more intense thermal fluxes for longer times since the consumption of the energy required for the evaporation of the contact (electrode) material is extremely high. Moreover, the layer of molten metal with a thickness of more than 3 mm tends to leave the contact (electrode) area by intense spraying, which leads to formation of large irregularities on contact areas.

The rate of cooling during the cooling step depends on the temperature of said surface and usually ranges from $10^4$ to $10^6$ K/s so as to allow the layer of molten metal to crystallize within a time interval not exceeding 10 ms. The diffusion that takes place during that time interval causes the formation of inclusions whose size does not exceed $\sqrt{Dt} \approx 3$ μm, where D is the diffusion coefficient equal to $10^{-5}$ cm$^2$/s and t is the diffusion time in seconds. As a result, a fine-grain structure is formed which may be called "pseudoeutectic".

BRIEF DESCRIPTION OF THE DRAWINGS

The invention will now be described in more detail with reference to the accompanying drawings in which:

FIG. 1 shows the structure of a contact made of a chrome-copper material (64 percent chrome and 36 percent copper, by weight), which has been treated in accordance with the method disclosed in the instant invention; and FIG. 2 shows the structure of a contact made of the same material, which has been treated in accordance with the method disclosed in the USSR Inventor's Certificate No. 756,510.

Referring to FIG. 1, the structure of a contact 1 is represented by the structure of a fused surface layer 2 and by a source structure 3 of the contact 1. The source structure 3 of the contact 1 comprises two phases as follows: a chrome-base phase 4 and a copper-base phase 5.

The structure of the contact 1 as shown in FIG. 1 is obtained in accordance with the proposed method which comprises the steps of exposing the contact surface to a concentrated thermal flux of $1.10^5$ W/cm$^2$ for 40 ms in a vacuum established at $10^{-3}$ Pa, during which exposure a surface layer of molten metal is formed, and subjecting said molten layer to cooling at a cooling rate of $1.10^4$ K/s, during which cooling a fused surface layer 2 of even thickness is formed 120 to 130 μm thick. The fused layer has a fine-grain structure. Being nonporous, it offers higher hardness and strength and contains small amount of gas contaminants. With the contact 1 prepared in accordance with the above steps, the electric strength of an electric vacuum apparatus is increased by a factor of 1.5, with the result that the apparatus dimensions and weight are decreased and its operational reliability is improved.

Referring to FIG. 2, the structure of a contact 1 comprises very small separate fused areas 6 of the surface of the contact 1 and a source structure 3 of the contact 1 including phases 4 and 5 described above.

The structure of the contact material shown in FIG. 2 is obtained in accordance with the known method of contact preparation (cf. the USSR Inventor's Certificate No. 756,510), comprising the steps of exposing the contact surface to a concentrated thermal flux of $1.10^5$ W/cm$^2$ in a vacuum established at $10^{-3}$ Pa for 10 ms, during which exposure no contact surface melting takes place, and subjecting the contact surface to subsequent cooling. This method allows for the removal of chemically sorbed gases from the contact surface; in this condition, no layer of molten metal is formed and the source structure of the contact material undergoes an insufficient change. Formed on the contact surface are very small separate fused areas 6, which do not influence the contact hardness and strength and could not, therefore, improve the electric strength and operational reliability of an electric vacuum apparatus.

The discussion above as referred to FIGS. 1 and 2 also applies to electrodes having their structure analogous to that described in the case of contacts.

BEST MODE FOR CARRYING OUT THE INVENTION

According to the instant invention, the sources producing said concentrated thermal fluxes may be powerful arc generators, plasma generators, lasers, electron beam generators, etc. In the case of quantity production, it is good practice to use an installation which generates a powerful arc in a vacuum.

The contact surface is cooled down in accordance with the proposed method with a cooling rate of $10^4$ to $10^6$ K/s, the cooling being provided by thermal conductivity of the contact (electrode) material.

With the proposed method, it is possible to prepare contact and electrodes fabricated by powder metallurgy method and by casting.

The examples below illustrate some embodiments of the present invention and allow one to gain better understanding of the object of the invention.

EXAMPLE 1

Using powder metallurgy method, a chrome-copper blank is fabricated which contains by weight 64 percent chrome and 36 percent copper and from which contacts are machined. The next step deals with the assembling of an arc extinction chamber. The chamber contacts are processed by using a concentrated thermal flux of $1.10^4$ W/cm$^2$ in a vacuum established at $10^{-3}$ Pa for 40 ms. The concentrated thermal flux of said magnitude is produced by initiating an arc between the contacts through which a current of 30 kA is passed. The treatment results in melting the contact surface. After that, the contact surface (the layer of molten metal) is subject to cooling at a cooling rate of $1.10^4$ K/s, with the result that a fused surface layer of the metal is obtained.

With the contact procedure completed, the arc extinction chamber is subject to electric strength test, the test results are shown in a table at the end of section Examples.

EXAMPLE 2

Using powder metallurgy method, a chrome-copper blank is fabricated which contains by weight 64 percent chrome and 36 percent copper and from which contacts are machined. The contact surface is then processed by means of a plasma source producing a concentrated thermal flux of $3.5 \cdot 10^5$ W/cm$^2$ in the atmosphere of an inert gas (argon) for 27 ms. The plasma source is an arc-type plasma generator rated for 100 kW. The distance between the end of the generator nozzle and the contact surface is equal to 60 mm. The contact surface is then cooled down at a cooling rate of $1.10^5$ K/s.

With the contact preparation procedure completed, a vacuum arc extinction chamber is assembled which is subject to electric strength test. For the test results see the table mentioned above.

EXAMPLE 3

Using powder metallurgy method, an iron-base blank is fabricated which contains by weight 26 percent copper, 4 percent antimony, with iron constituting balance and from which electrodes are machined. The electrode surface is then exposed to a concentrated thermal flux of $1.10^6$ W/cm$^2$ in the atmosphere of an inert gas (argon) for 21 ms. This thermal flux is produced by striking an arc between the contacts at 45 kA. The electrode surface is then cooled down with a cooling rate of $5.10^5$ K/s.

With the electrode preparation procedure completed, a vacuum gap is assembled which is subject to electric strength test. For the test results, see the table mentioned above.

EXAMPLE 4

Using casting method, a chrome-copper blank is fabricated which contains by weight 50 percent chrome and 50 percent copper and from which contacts are machined. The contact surface is then exposed to a concentrated thermal flux of $7.10^5$ W/cm$^2$ in the atmosphere of an inert gas (argon) for 100 ms. This thermal flux is obtained by striking an arc between the contacts at 48 kA. The contact surface is then cooled down at a cooling rate of $1.10^6$ K/s.

With the contact preparation procedure completed, a vacuum arc extinction chamber is assembled and tested for electric strength. The test results are given in the table mentioned above.

The table lists the test results relating to the proposed method and the known method of the USSR Inventor's Certificate No. 756,510. According to the known method, the contact (electrode) surface is exposed in a vacuum of $10^{-3}$ Pa to a concentrated thermal flux of $1.10^5$ W/cm$^2$ that is produced by striking an arc at 15 kA.

The electric strength is determined by measuring the first breakdown voltage, with the distance between contacts (electrodes) equal to 1.5 mm.

TABLE

| Contact (electrode) preparation method | First breakdown voltage, kV, eff. | | |
|---|---|---|---|
| | average | maximum | minimum |
| As disclosed in the USSR Inventor's Certificate No. 576,510 | 26.2 | 38 | 23 |
| As per Example 1 herein | 37.6 | 41 | 33 |
| As per Example 2 herein | 37.5 | 41.5 | 33.5 |
| As per Example 3 herein | 37.7 | 41 | 33 |
| As per Example 4 herein | 38 | 42 | 34 |

The data of the table show that the proposed method gives a 50 percent increase in the electric strength of an electric vacuum apparatus, thereby improving its operational reliability.

INDUSTRIAL APPLICABILITY

The invention is suitable for use in the fabrication of electric vacuum apparatuses.

We claim:

1. A method of preparing contacts and electrodes of electric vacuum apparatuses comprising the steps of exposing the surface of the contacts (electrodes) to a concentrated thermal flux of $10^4$ to $10^6$ W/cm$^2$ in a vacuum or in the atmosphere of an inert gas and subjecting said surface to subsequent cooling, said concentrated thermal flux is applied for 21 to 100 ms and a rate of cooling during the cooling step is chosen to be within the range $10^4$ to $10^6$ K/s.

* * * * *